US005621927A

United States Patent [19]

Reiss et al.

[11] Patent Number: 5,621,927

[45] Date of Patent: Apr. 22, 1997

[54] UTILITY TRAY AND BATHTUB CADDIE

[76] Inventors: Amy Reiss, 659 Radcliffe Ave., Pacific Palisades, Calif. 90272; Marjorie B. Friedman, 521 Montana, #307, Santa Monica, Calif. 90403; Mark Shufelt, 10373 High St., Albion, Pa. 16401

[21] Appl. No.: 384,475

[22] Filed: Feb. 1, 1995

Related U.S. Application Data

[63] Continuation of Ser. No. 81,579, Jun. 22, 1993, abandoned.

[51] Int. Cl.[6] ..... A47K 3/00

[52] U.S. Cl. ..... 4/559; 4/605; 248/206.4; 248/447.1

[58] Field of Search ..... 4/546, 597, 605, 4/559, 579; 248/296.1, 447.1, 467, 206.3, 206.4

[56] References Cited

U.S. PATENT DOCUMENTS

| | | | |
|---|---|---|---|
| D. 250,439 | 12/1978 | Holstein | D6/86 |
| 488,608 | 12/1892 | Hotchkiss | 248/296 X |
| 1,198,186 | 9/1916 | Brown | 248/296 X |
| 2,302,806 | 11/1942 | Senter | 4/559 X |
| 2,896,895 | 7/1959 | Speese | 4/559 X |
| 3,168,276 | 2/1965 | Schneider | 248/467 |
| 3,239,850 | 3/1966 | Kiss | 4/559 |
| 3,497,882 | 3/1970 | Weeks | 248/447.1 X |
| 3,834,782 | 9/1974 | Pampinella | 312/248 |
| 3,948,476 | 4/1976 | Kuniyosi | 248/206.4 X |
| 4,098,486 | 7/1978 | Hornsby | 248/452 |
| 4,628,550 | 12/1986 | Walton | 4/560.1 |
| 4,887,323 | 12/1989 | DiVito et al. | 4/559 X |
| 4,943,018 | 7/1990 | Glaser et al. | 248/206.4 X |
| 5,221,070 | 6/1993 | Heilmer | 248/447.1 |

OTHER PUBLICATIONS

*Chambers*, "Furnishings for Bed and Bath," Spring 1992, 3 pages.

Johnson, U.S. Patent 3,295,470, claim 1, filed Dec. 1965.

Tempchin, US Patent D246,403, 1 drawing figure, filed Aug. 1976.

Chapman, US patent D247,013, 1 drawing figure, filed Jun. 1976.

Barker, US Patent D211,189, 1 drawing figure, filed Feb. 1967.

*Primary Examiner*—Robert M. Fetsuga

*Attorney, Agent, or Firm*—Loeb & Loeb

[57] ABSTRACT

An improved utility tray and bathtub caddie has a support member for supporting a tray and book stand in the vicinity of a conventional bathtub. The tray or caddie comprises a book rest, a pivotal arm for supporting the book rest, a support member for pivotally supporting the pivotal arm and a securing apparatus for securing the support member to a fixture, such as a bathtub, a tile wall adjacent a bathtub or other suitable fixtures. The pivotal arm is supported for pivotal motion over a bathtub, such that the book rest may be conveniently positioned over a bather in a location in which the bather can easily access the book rest and/or view reading material held on the book rest. The pivotal arm may be pivoted to move the book rest toward one side of the bathtub so as to allow the bather to easily enter and exit the bathtub without disturbing items held on the book rest. Several embodiments are disclosed.

14 Claims, 8 Drawing Sheets

UTILITY TRAY AND BATHTUB CADDIE

This is a continuation of application Ser. No. 08/081,579 filed on Jun. 22, 1993, now abandoned.

FIELD OF THE INVENTION

The present invention relates to an improved utility tray and, in particular embodiments, to a versatile and convenient bathtub caddie having a tray, book stand and a support structure for temporarily securing the tray and book stand in the vicinity of a conventional bathtub.

BACKGROUND OF THE INVENTION

Various types of utility trays and bathtub caddie trays have been available for several years. Examples of such are shown in U.S. Pat. No. 3,950,793 to Adams (issued Apr. 20, 1976); U.S. Pat. No. 3,239,850 to Kiss (issued Mar. 20, 1963); and U.S. design patent Des. 250,439 to Holstein (issued Dec. 5, 1978). These patents describe trays which are placed on the upper surfaces of two opposed bathtub side walls and extend between the bathtub side walls, over the tub basin. One concern regarding these designs is that the tray could be easily slid off of one or both side walls, causing any items held on the tray to be dropped into the tub basin. Moreover, because these designs require the tray to be suspended over the tub basin at all times, these designs often make it awkward for the bather to enter or exit the bathtub without disrupting the tray or its contents.

As an alternative, U.S. Pat. No. 3,834,782 to Pampinella (issued Sep. 10, 1974) describes a wall mounted caddie design which supports a toiletries container for swinging motion over a bathtub. However, according to this design, the caddie is permanently attached to the wall and has very limited adjustment features. Installation can be difficult, especially when installed on a tile wall. Moreover, the structure of the caddie is relatively complicated, which would likely result in a relatively high cost of manufacture.

Thus, while various utility and bathtub tray caddies have been proposed, typical proposed designs are found to be relatively cumbersome to use, difficult to install, difficult or impossible to adjust to fit a particular installation requirement (e.g., bathtub size) or to fit a particular bather, and relatively expensive to manufacture. There is a need in the industry for an improved utility tray and bathtub caddie which addresses some or all of the above concerns.

SUMMARY OF THE DISCLOSURE

The present invention relates to an improved utility tray and, in particular embodiments, to a bathtub caddie for securing a tray and book stand in the vicinity of a conventional bathtub. Embodiments of the invention provide these features with a structure formed of a relatively small number of components that are relatively easy and economical to manufacture and that can be easily assembled and secured in the vicinity of a conventional bathtub without the need for tools and without the need to damage the bathtub or the surrounding walls and other fixtures. Preferred embodiments provide several adjustment features which allow the user to readily adjust various parameters for user comfort and ease of installation.

A bathtub tray according to an embodiment of the present invention comprises a book rest, a pivotal arm for supporting the book rest, a support member for pivotally supporting the pivotal arm and a securing means for securing the support member to a fixture, such as a bathtub, a tile wall adjacent a bathtub or other suitable fixtures. In preferred embodiments, the pivotal arm is supported for pivotal motion over a bathtub, such that the book rest may be conveniently positioned over a bather in a location in which the bather can easily access the book rest and/or view reading material held on the book rest. The pivotal arm may be pivoted to move the book rest toward one side of the bathtub so as to allow the bather to easily enter and exit the bathtub without disturbing items held on the book rest.

In preferred embodiments, the support member comprises a vertical support arm and the securing means comprises a pair of suction cups coupled to the support arm for securing the support arm to, e.g., a tile wall adjacent a conventional bathtub. Preferred embodiments also provide several adjustment features which allow the user to readily adjust various parameters, including the position of the book rest along the length of the pivotal arm, the vertical height of the pivotal arm relative to the support member, the positions of the suction cups relative to the support member, the angular orientation of the book rest and the length of the pivotal arm.

In further preferred embodiments, the support member comprises a tray, a pair of support arms extending along the top surface of a bathtub side wall or the base of a bathtub side wall clamp and the securing means comprises a clamp adapted to grip the side wall of the bathtub. The clamp may be adjustable to accommodate various bathtub side wall widths.

Other features and advantages of the invention will become apparent from the following detailed description, taken in conjunction with the accompanying drawings, which illustrate, by way of example, features of embodiments of the invention. For instance, embodiments may be adapted for various other types of fixtures, including bathtubs, furniture, laboratory fixtures, work shop fixtures or the like.

DETAILED DESCRIPTION OF THE DISCLOSURE

As noted above, the present invention relates to an improved utility tray and, in particular embodiments, to a versatile and convenient bathtub caddie having a tray, book stand and a support structure for temporarily securing the tray and book stand in the vicinity of a conventional bathtub.

Figure 1:
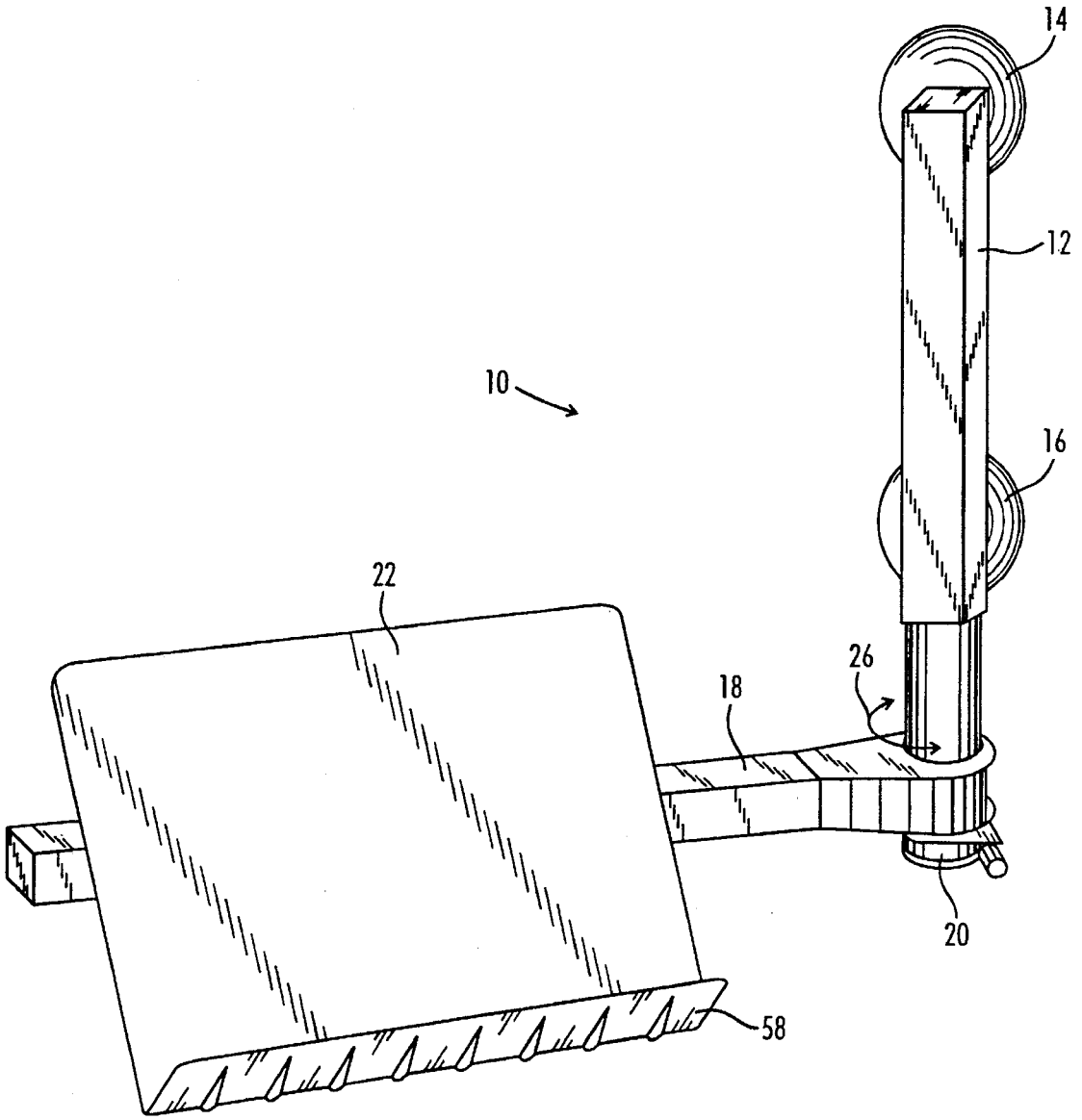
FIG. 1. is a perspective view of a bathtub tray according to a preferred embodiment of the present invention.

A bath tub caddie 10 according to a preferred embodiment of the invention is shown in FIG. 1. The caddie 10 includes seven basic components and hardware for coupling the components together. As can be readily appreciated, the small number of components and the relatively simple physical shapes of the components allow the caddie 10 to be easily and cost efficiently manufactured. Moreover, the components and coupling hardware are designed such that the caddie 10 may be constructed with minimal effort and mechanical aptitude and without the need for tools.

The seven basic components of the caddie 10 are a support arm or member 12, a pair of suction cups 14 and 16, a pivotal arm 18, a coupling ring 20, a book rest 22 and a book rest coupling bracket 24. These seven components are coupled together in the manner shown in FIGS. 1 and 2 to provide a bathtub caddie apparatus having an adjustable book rest or tray pivotally supported over a bathtub. The apparatus provides a bather with the convenience of a book support and/or a tray for holding items (e.g., books, magazines, bathing items, soaps, shampoos, lotions, nail polish, food, etc.) over the bathtub, allowing the bather to easily reach these items without exiting or leaning outside of the tub confines. As described in more detail below, the book support or tray is pivotally supported over the bathtub to allow the bather to easily swing the tray to one side of the bathtub so that the bather can easily enter or exit the bathtub without disturbing the contents of the tray.

Figure 2:
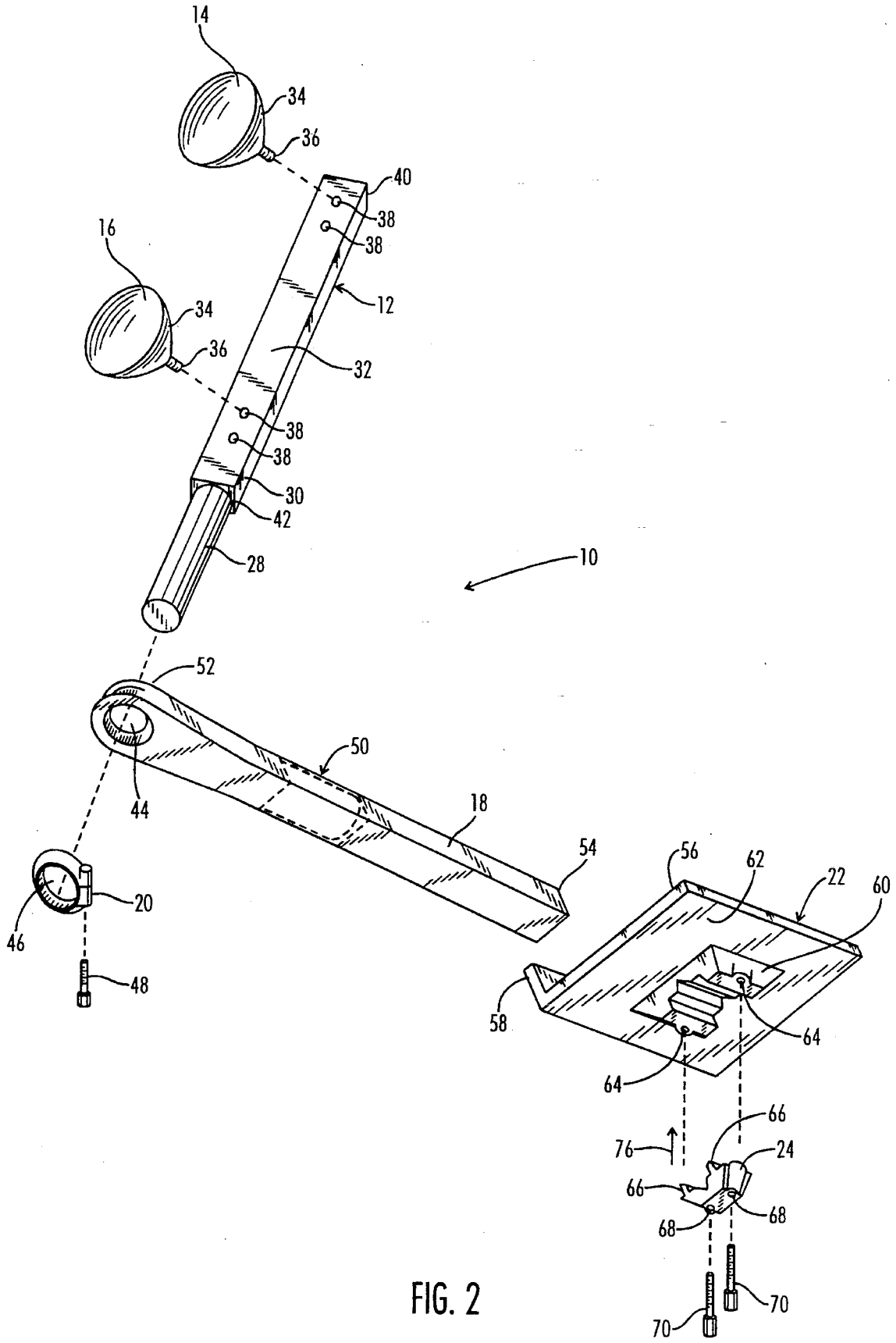
FIG. 2. is an exploded view of the bathtub tray embodiment shown in FIG. 1.

Referring to FIGS. 1 and 2, the book rest 22 is coupled to the pivotal arm 18 by the coupling bracket 24, in any one of several user selectable angles relative to a horizontal plane along the axis of the pivotal arm 18. The pivotal arm 18 is coupled to the support arm 12 by the coupling ring 20, for pivotal motion in the direction of arrow 26. The suction cups 14 and 16 are adapted to secure the support arm 12 to, for example, a tile wall (not shown) adjacent a bathtub (not shown).

The support arm 12 has generally cylindrical portion 28 (e.g., having a circular cross-section) and a generally squared portion 30 (e.g., having a rectangular, or other polygonal, cross-section). The squared portion 30 provides a flat surface 32 which is designed to face an existing wall, or other suitable structure, typically located adjacent conventional bathtubs, for example, a tile wall (or other types of walls, cabinets, mirrors, doors, or the like). Suction cups 14 and 16 are coupled to the support arm 12 at the flat surface 32. The suction cups 14 and 16 may be applied to any surface suitable for providing the necessary seal for maintaining the suction cups and, thus, the support arm 12, in a fixed relation relative to the surface.

Each suction cup 14 and 16 includes a flexible (rubber or rubber-like) cup 34 and a threaded shaft 36 extending from the back of the cup 34. The cups 34 are, preferably, molded from a flexible rubber or rubber-like material. The shafts 36 are preferably secured to the cups 34 by molding the cups 34 about the shafts 36 during the cup molding process. It will be understood, however, that further embodiments may employ other suitable types of suction cup structures.

The threaded shafts 36 mate with threaded holes 38 in the flat surface 32 of support arm 12, to secure the suction cups 14 and 16 to the support arm 12. Preferably, suction cup 14 is secured to the support arm 12 adjacent one end 40 of the support arm and suction cup 16 is secured to the support arm adjacent the union 42 of the cylindrical and squared portions 28 and 30 of the support arm. In further preferred embodiments, a plurality of threaded holes 38 are provided in the flat surface 32 adjacent the end 40 and a further plurality of threaded holes 38 are provided in the flat surface 32 adjacent the union 42, to allow the user to readily adjust the actual coupling location of each suction cup 14 and 16 along the length of the support arm 12. This feature allows the spacing between suction cups 14 and 16 to be adjusted to accommodate the particular wall (or other structure) surface to which the suction cups 14 and 16 are to be applied.

For example, if the suction cups 14 and 16 are to be applied to a tiled bathroom wall, it is preferred that each suction cup be centered with respect to the tile to which it is applied, such that the suction cup does not cross a grout line between adjacent tiles. (Crossing a grout line between tiles may adversely affect the vacuum or suction force needed to hold the suction cup to the tile.) The ability to adjust the spacing between the suction cups 14 and 16 allows the vertical location of each suction cup to be adjusted, to vertically center each suction cup on a respective tile. Horizontal adjustment may be readily accomplished by moving the entire caddie 10 in the horizontal direction. In preferred embodiments, the suction cups and the ability to adjust the vertical spacing between the suction cups allows the caddie 10 to be readily secured to a large variety of different walls or structures which are typically located adjacent conventional bathtubs, so that the caddie could be easily used in any one of a large number of different homes, apartments, hotels, or the like, without additional modifications.

The cylindrical portion 28 of the support arm 12 defines a rounded outer peripheral surface about which the arm 18 is pivotal. In particular, the pivotal arm 18 has a rounded aperture 44 through which the cylindrical portion 28 of the support arm 12 extends. The diameter of the rounded aperture 44 is preferably close to, but slightly larger than, the outside diameter of the cylindrical portion 28, to provide a relatively snug fit of the cylindrical portion 28 in the aperture 44, but allow the cylindrical portion to slide vertically relative to the arm 18 and further allow the arm 18 to pivot about the cylindrical portion 28.

The coupling ring 20 is coupled to the cylindrical portion 28 of the support arm 12, below the pivotal arm 18. The coupling ring, therefore, inhibits the pivotal arm 18 from sliding vertically downward, e.g., due to gravity, along the length of the cylindrical portion 28. In the illustrated embodiment, the coupling ring 20 comprises a variable diameter ring, defining a central opening 46 through which the cylindrical portion 28 extends. The diameter of the central opening is adjusted by rotating a thumb screw 48. In this manner, the ring diameter may be decreased once the ring 20 is placed over the cylindrical portion 28 so as to clamp the ring 20 about the cylindrical portion 28. The outside diameter of the ring 20 is larger than the inside diameter of the aperture 44 in the pivotal arm 18, such that the pivotal arm 18 engages and rests on the ring 20, when the caddie is assembled as shown in FIG. 1.

The pivotal arm 18 has a generally rectangular cross-section over a majority of its length. (An optional rounded cross-section portion 50 is discussed below.) It will be understood that further embodiments may employ arms having other suitably shaped cross-sections, such as triangular, hexagonal or other polygonal cross-sections. As discussed above, the aperture 44 is located adjacent one end 52 of the pivotal arm 18. The arm 18 may be enlarged in, for example, the width dimension, in the vicinity of the arm end 52 to provide suitable structural strength about the aperture 44. The pivotal arm 18 extends from the support arm 12 in a cantilever arrangement, such that the pivotal arm 18 defines a free end 54 opposite the arm end 52.

The book rest coupling bracket 24 cooperates with the book rest 22 to couple the book rest 22 to the pivotal arm 18. In particular, the book rest 22 defines an upper surface 56 for supporting a book or other items such as noted above. Preferably, a lip or ledge 58 is disposed along one edge of the upper surface to provide additional support, for example, to support a book, magazine or other reading material in an upward angled orientation. A bracket mating member 60 extends from the lower surface 62 of the book rest 22 and is adapted to mate with coupling bracket 24, to provide a mechanism for coupling the book rest 22 to the pivotal arm 18 in any one of several user selectable angular orientations relative to a horizontal plane along the axis of arm 18. One such angular orientation may be a horizontal orientation, wherein the upper surface 56 of the book rest 22 is arranged parallel (or almost parallel) to a horizontal plane. In this horizontal (or near horizontal) orientation, the upper surface 56 may be used as a tray surface for various items as discussed above. However, for simplifying the present disclosure, the structure 22 is referred to herein as a "book rest", regardless of its angular orientation.

The bracket mating member 60 has a generally frustum shape with one half of a "star-shaped" passage formed in the smaller one of the two parallel frustum surfaces. In addition, a pair of threaded apertures 64 is provided in the smaller of the two parallel frustum surfaces. The coupling bracket 24 also has a generally frustum shape and includes two legs 66 extending from the larger one of the two parallel frustum surface. Each leg 66 defines surfaces which face the other leg 66. These leg surfaces and the surface of the coupling bracket 24 extending between the legs 66 define the other half of the "star-shaped" passage.

A pair of apertures 68 are provided in the coupling bracket 24 to align with the threaded apertures 64, upon the coupling bracket 24 mating with the bracket mating member 60. A pair of threaded thumb bolts 70 extend through the apertures 68 and are threaded into the threaded apertures 64 to secure the coupling bracket 24 in its mating position relative to the bracket mating member 60.

Figure 3:
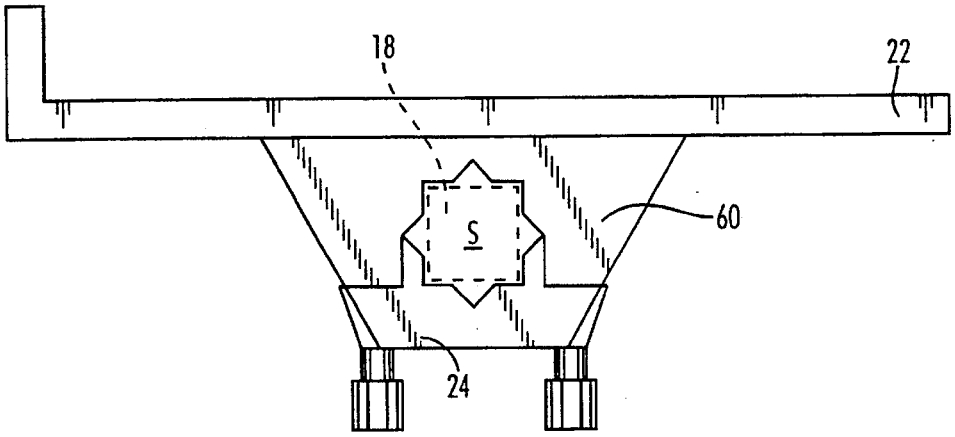
FIG. 3 is a side view of the book rest and coupling bracket of the FIG. 1 embodiment in a first angular orientation relative to the pivotal arm of the FIG. 1 embodiment.
Figure 4:
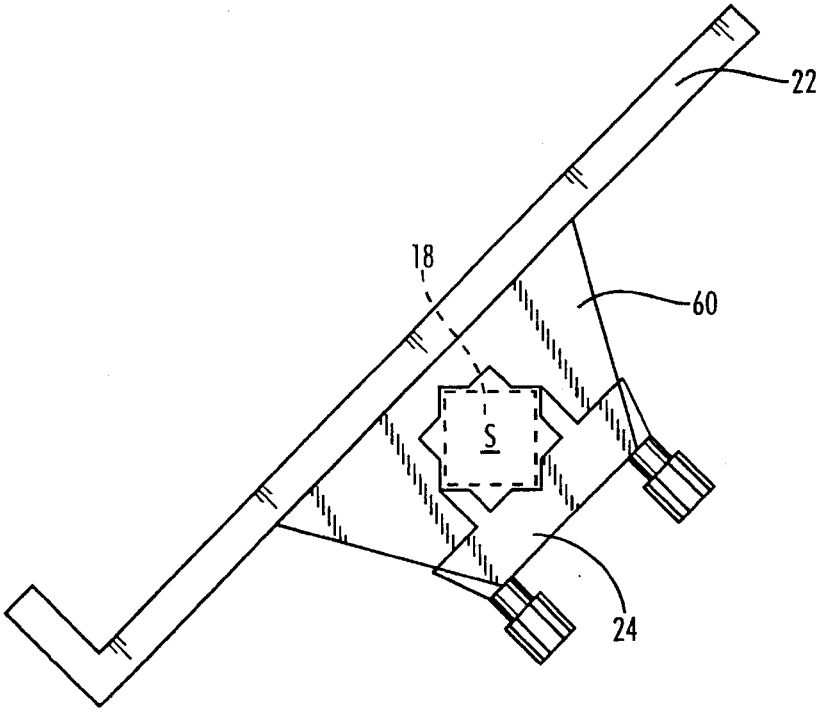
FIG. 4 is a side view of the book rest and coupling bracket of the FIG. 1 embodiment in a second angular orientation relative to the pivotal arm of the FIG. 1 embodiment.

As best shown in FIGS. 3 and 4, when the bracket mating member 60 mates with the coupling bracket 24, they define an eight point "star-shaped" passage, with each point defining a right angle. The number of "star" points (eight in the illustrated embodiment) and the angle defined by each "star" point (right angles in the illustrated embodiment) is determined, in part, by the number of corners and the angle of each corner of cross-sectional shape of the pivotal arm 18. The number of "star" points is also determined, in part, by the desired number of user selectable angular positions of the book rest.

For example, in the illustrated embodiment, the cross-sectional shape of the pivotal arm 18 is square (as shown at reference character S) and, therefore, the number of corners is four and angle of each corner is 90°. (The broken line portion of FIGS. 3 and 4 represents the cross-section shaped square S of the pivotal arm 18.) In this regard, the angle of each point of the star-shaped passage shown in FIGS. 3 and 4 is 90°. This allows each 90° corner of the square S to fit within a respective 90° point of the "star". Moreover, the dimensions of the star-shaped passage are designed to allow any one corner of the square S to fit into any one of the eight points of the "star" and to, therefore, allow the user to select which "star" point receives a corner of the square S. In this manner, the user may select the angular orientation of the book rest surface 56 relative to a horizontal plane along the axis of the pivotal arm 18, as represented in FIGS. 3 and 4.

While the illustrated embodiment employs a bracket mating member 60 and coupling bracket 24 which define an eight point star-shaped passage with 90° points and a pivotal arm 18 having a square cross-section, it will be understood that further embodiments may employ structure which defines fewer or more "star" points, points with angles other than 90° and/or pivotal arms with cross-sectional shapes defining fewer or more than four corners. In yet further embodiments, the shape of the passage defined by the bracket mating member and the coupling bracket may be other than a "star" configuration and the cross-sectional shape of the pivotal arm may be other than polygonal, so long as the cross-sectional shape of the pivotal arm corresponds with the cross-sectional shape of the passage to provide a plurality of user selectable orientations of the pivotal arm within the passage.

Thus, as discussed above, the coupling bracket 24, bracket mating member 60 and the pivotal arm 18 cooperate to allow the user to select a desired angular orientation of the book rest 22 from a plurality of optional angular orientations. In a preferred embodiment, the thumb bolts 70 may be tightened so as to draw the coupling bracket further toward the lower surface 62 of the book rest (e.g., to draw legs 66 along the surfaces 72 of the bracket mating member 60 in the direction of arrow 76) to effect a clamping force on the pivotal arm 18. The clamping force inhibits movement of the book rest 22 relative to the pivotal arm 18, thereby locking the book rest 22 at its preselected angular orientation relative to the pivotal arm 18.

If the thumb bolts 70 are sufficiently loose, the book rest 22 (and bracket mating member 60 and coupling bracket 24) may be readily moved (e.g., by sliding) along the length of the pivotal arm 18. In one embodiment, a book rest which is supported in a first angular orientation may be slid off of the free end 54 of the pivotal arm 18, shifted to another selectable angular orientation and then slid back onto the free end 54 in its new angular orientation. The book rest 22 may then be slid along the length of the pivotal arm 18 to the desired location along the arm 18. In this manner, the position of the book rest 22 along the arm 18 may be user selectable. Once the book rest 22 is in the user selected location along arm 18 and is in the user selected angular orientation, thumb screws 70 may be tightened so as to lock the book rest 22 relative to the pivotal arm 18.

In further embodiments, the book rest 22 need not be slid off of the free end 54 of the pivotal arm 18 to change the angular orientation of the book rest. Instead, the pivotal arm 18 may include a circular cross-section and/or reduced diameter length portion 50 along its length. In this embodiment, the user need only slide the book rest along the arm 18 to the location in which the arm portion 50 is located within the "star-shaped" passage defined by member 60 and bracket 24. The arm portion 50 either lacks the corners necessary for engaging the "star" points and/or has too small of a diameter to engage the "star" points. This allows the book rest 22 to be rotated about the axis of arm 18 so as to re-adjust the angular orientation of the book rest 22 relative to the arm 18. Once a desired angular orientation is found, the book rest is slid away from the arm portion 50, such that the "star-shaped" passage defined by member 60 and bracket 24 may then re-engage corners of the pivotal arm 18, as discussed above.

While the illustrated embodiments employ the above described pivotal arm with polygonal cross-section shaped to engage the "star-shaped passage" at any one of multiple angular orientations, other embodiments may employ other suitable angle adjusting coupling means for coupling the book rest to the pivotal arm at any one of multiple angles relative to a horizontal plane. For example, pivot or universal joints may be employed, preferably of the high friction type, as employed on conventional sheet music stands, to allow the angle of the book rest, relative to a horizontal plane, to be adjusted and maintained in its adjusted position.

Figure 5:
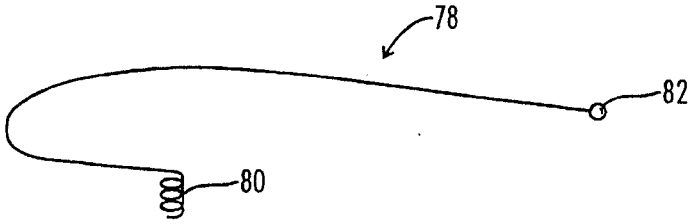
FIG. 5 is a front view of a spring wire according to the FIG. 1 embodiment.

A pair of book page holders, in the form of spring wires 78, may be coupled to the book rest 22, e.g., on the lip 58, as shown in FIGS. 1 and 5. Each spring wire 78 includes a coil portion 80 at one end and a ball 82 (e.g., a plastic ball) at the opposite end. The length of the wire between the coil 80 and the ball 82 is curved such that, upon sliding a portion of the book rest 22 or lip 58 between adjacent loops of the coil 80, the spring wire 78 will be coupled to the book rest 22 and the ball 82 will be forced against the upper surface 56 of the book rest by the spring tension of the spring wire. When a book is opened on the book rest 22, one spring wire 78 may be arranged such the its ball 82 presses the right side book page toward the upper surface 56, and the other spring wire 78 may be arranged such that its ball 82 presses the left side book page toward the upper surface 56. The book will then be positively held in place, in its open state, on the book rest 22. It will be understood that further embodiments may include other types of clips or document holding devices, for example, standard clip-board type clips, magnets (provided the upper surface 56 is magnetic or is made of a material to which magnets are attracted) or the like. In further preferred embodiments the top surface of the book rest defines a tray surface and may be provided with a plurality of compartments therein.

In preferred embodiments, the support arm 12, pivotal arm 18, coupling ring 20, book rest 22 and coupling bracket 24 are each made of a relatively light weight, high strength material, such as plastic. The shapes of these components readily lend themselves to many types of manufacturing techniques, such as injection molding or other molding, extrusion or other suitable processes. In further preferred embodiments, the support arm 12 and the pivotal arm 18 are generally hollow, to minimize the weight of the structure.

As discussed above, the suction cups 14 and 16 include cup members 34 which may be molded or otherwise manufactured from any suitable flexible, air impermeable material, such as rubber or rubber-like materials. Suction cups are preferred because they are very versatile with respect to the type of wall or other structure to which the caddie attaches, they can be removably attached to the wall or other structure without damaging the wall or other structure, they can be readily removed from the wall or other structure or re-attached thereto in a moments notice, they are readily and cost efficiently manufactured, they are very easy to use and require no tools for operating. However, in further embodiments, other types of coupling devices may be used as an alternative to suction cups, including but not limited to bolts, screws, nails, rivets, clamps, adhesives or the like.

Also as discussed above, the support arm 12 shown in FIGS. 1 and 2 has a squared portion 30 and a cylindrical portion 28. However, in further embodiments, the entire length of the support arm 12 may be cylindrical. Alternatively, the squared portion 30 may have any other suitable cross-section shape.

Furthermore, the illustrated embodiment employs a coupling ring 20 to rotatively hold the pivotal arm 18 on the support arm 12 and to allow the vertical height of the pivotal arm relative to the support arm to be adjusted. However, in other embodiments, the pivotal arm 18 may be pivotally supported on support arm 12 by other suitable pivotal connectors, including a ball bearing assembly coupled by its races to the arms 12 and 18, well known pivot or universal joints, or the like.

In addition, the illustrated embodiment employs a bracket mating member 60, coupling bracket 24 and a pivotal arm 18 having a polygonal cross-section for allowing the book rest 22 to be coupled to the arm 18 in any one of a plurality of user selectable angular orientations and at any one of several user selectable locations along the length of the arm 18. The member 60, bracket 24 and arm 18 are preferred for providing these adjustment features, because these components are durable, and are relatively easy to manufacture, assemble and use. However, in further embodiments, these adjustment features may be provided by other suitable means, including a sliding sleeve (not shown) supported for sliding along the length of the pivotal arm 18 and for rotation about the axis of the arm 18. With the sliding sleeve embodiment, the arm 18 preferably has a circular cross-section along the majority of its length and the sleeve preferably has a locking pin, screw, bolt or the like, which selectively contacts the arm 18 to selectively lock the sleeve relative to the arm.

Furthermore, the embodiment illustrated in FIGS. 1–4 employs threaded thumb bolts 48 and 70 for coupling various members together, as discussed above. Thumb bolts are preferred because they are readily available at a relatively low cost, they are easy to use and require no tools. (Thumb bolts define a relatively wide gripping handle adapted to be gripped between the user's thumb and forefinger and to be rotated with the force from the user's thumb and finger.)

As is readily apparent from the discussion above, the bathtub caddie 10 shown in FIGS. 1–4 provides several advantages with respect to ease of manufacture, ease of assembly, adjustability of several different parameters and ease of use. The caddie 10 may be manufactured and shipped as unassembled components to be assembled by the ultimate purchaser or user. To assemble, first the user may hold the support arm 12, with its axis arranged substantially vertically, adjacent the wall or other structure to which the caddie will be secured. By visually comparing the wall or other structure with the locations of the holes 38 (e.g., comparing the locations of the tiles on the wall with the locations of the holes 38), the user may then select which holes 38 will be used to attach the suction cups 14 and 16 to the support arm 12. The suction cups 14 and 16 are then secured to the support arm by threading the shafts 36 into the selected holes 38. The relatively large cup portions 34 of each suction cup 14 and 16 provide a convenient location for the user to readily grip and turn the suction cups 14 and 16 to cause the shafts 36 to thread into the pre-selected holes 38, without the need for tools.

The cylindrical portion 28 of the support arm 12 is then passed through the aperture 44 in the pivotal arm 18. Once the cylindrical portion 28 is extended through the aperture 44, the coupling ring 20 is placed over the free end of the cylindrical portion, below the pivotal arm 18. The vertical location of the pivotal arm 18 along the length of the cylindrical portion 28 is then selected by sliding the arm 18 along the length of portion 28. Once the vertical location of the pivotal arm 18 is selected, the coupling ring 20 is slid along the cylindrical portion 28 to a position below and in contact with the pivotal arm 18. The thumb bolt 48 is then tightened by hand so as to fixedly clamp the ring 20 to the cylindrical portion 28.

The book rest coupling bracket 24 is then loosely coupled to the bracket mating member 60, via thumb bolts 70. The angular orientation of the book rest is then selected and the book rest 22 (via the bracket 24 and member 60) is slid onto the free end 54 of the pivotal arm 18 in its pre-selected angular orientation. The book rest 22 is then moved along the length of the arm 18 to the position desired by the user. Once the book rest 22 is in its user selected position along the length of arm 18 and is in its user selected angular orientation, the thumb bolts 70 may be tightened so as to fixedly lock the book rest 22 relative to the pivotal arm 18.

The assembled caddie 10 may then be mounted adjacent a bathtub, e.g., on a tiled wall or the like. This is accomplished by moistening the suction cups 14 and 15 and pressing them against the wall or other structure adjacent the bathtub, with the support arm 12 directed substantially vertically and with the cylindrical portion 28 at the lower vertical end of the arm 12. Preferably each suction cup is dimensioned to fit within the boundaries of a single tile (without extending over the grout area between adjacent tiles), so as to maximize the effectiveness of the suction cups. With the caddie 10 so mounted adjacent the bathtub, further adjustments of the height of the pivotal arm 18 along the cylindrical portion 28, of the angular orientation of the book rest 22 or of the location of the book rest 22 along the length of the arm 18, may by made.

Figure 6:
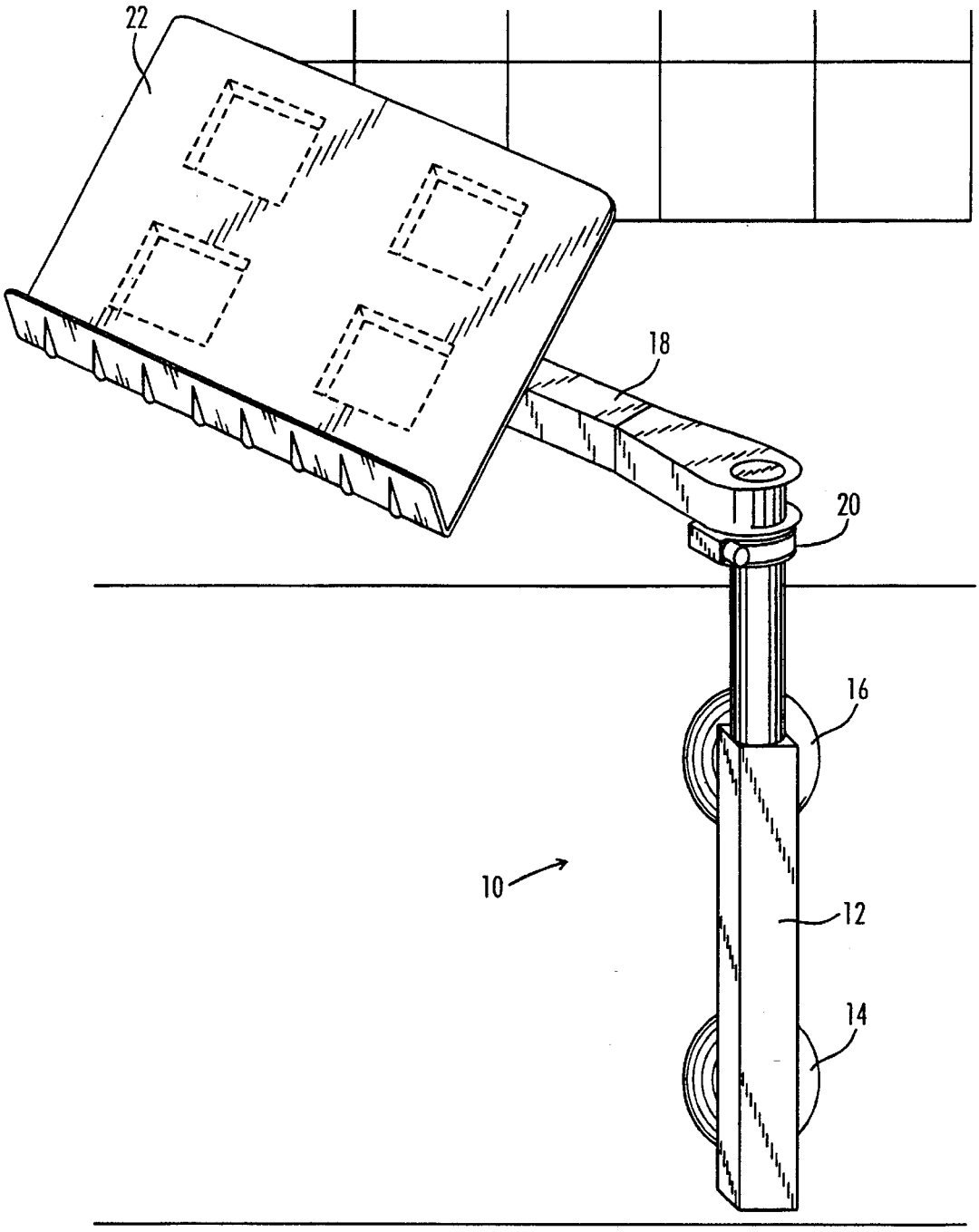
FIG. 6 is a perspective view of a bathtub tray as shown in FIG. 1, but assembled to support the book rest above the suction cups.

The versatile structure of the FIG. 1 embodiment allows the pivotal arm 18 to be coupled to the support arm 12 at a location above the suction cups 14 and 16 as shown in FIG. 6 (as opposed to the location below the suction cups 14 and 16 shown in FIGS. 1 and 2. In this arrangement, the coupling ring 20 is arranged on the support arm 12 before the pivotal arm 18 is mounted on the support arm. As a result, the caddie may be supported adjacent a bathtub by applying the suction 14 and 16 to the outer wall of the tub basin itself, as shown in FIG. 6. Similarly, the suction cups 14 and 16 may be applied to the inner wall of the tub basin. If the wall to which the suction cups are applied is angled (as is the case with the inner wall of many modern bathtubs), a spacer (not shown) may be arranged between one of the suction cups and the support arm 12 such that the support arm 12 may be secured to the wall in a vertical or near vertical orientation.

In preferred embodiments, the caddie 10 is mounted adjacent a bathtub such that the pivotal arm 18 my swing directly over the tub from a first position wherein the book rest 22 is located in front of a bather (at a suitable height to allow the bather to easily view and access the upper surface 56) to a second position against the wall (or other structure) to which the suction cups 14 and 16 attach. The bather may readily swing the pivotal arm 18 to the second position, when entering or exiting the bathtub and may readily swing the arm 18 to the first position when inside of the bathtub.

Further bathtub caddie embodiments are shown in FIGS. 7–13, wherein clamps, rather than suction cups, are employed to support the caddies adjacent the bathtub. These further embodiments are particularly suitable for, but not limited to, use with a bathtub 100 having a bathtub sidewall 101 with dimensions suitable to be gripped by a caddie clamp.

Figure 7:
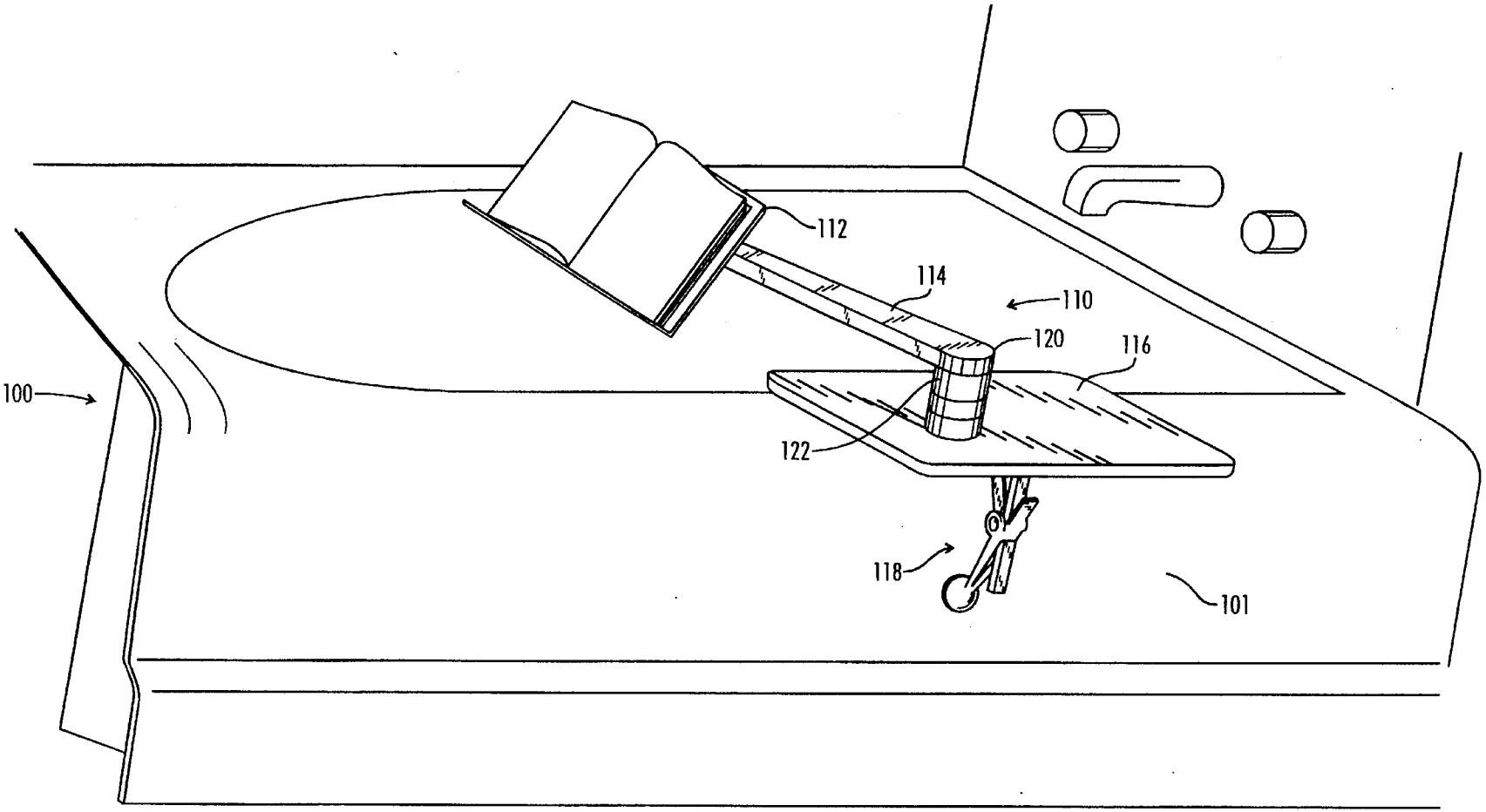
FIG. 7 is perspective view of a bathtub tray according to another preferred embodiment of the present invention.
Figure 8:
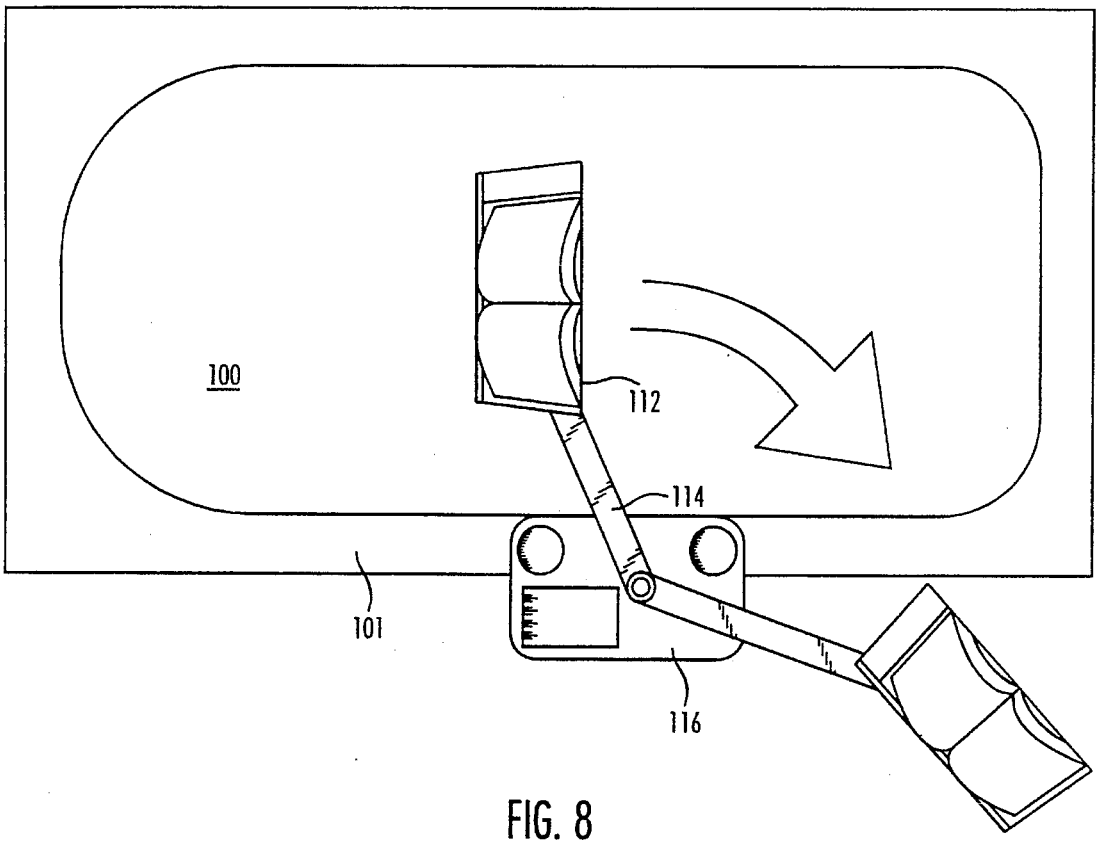
FIG. 8 is a top view of a modified version of the bathtub tray in FIG. 7.

FIG. 7 shows a bathtub tray 110 having a book rest 112, a pivotal arm 114 for supporting the book rest, an accessory tray 116 to which the arm 114 is pivotally coupled, and a clamp 118 for attaching the accessory tray 116 to a bathtub side wall 101. The accessory tray 116 may be provided with article retaining means, e.g., in the form of depressions or compartments molded into the tray surface as shown in FIG. 8 or containers attached to the tray surface.

The book rest 112 may be similar to the book rest 22 in the FIG. 1 embodiment and may be coupled to the pivotal arm 114 in any suitable manner, including the manner in which book rest 22 is coupled to pivotal arm 18 in the FIG. 1 embodiment. Preferably, the book rest 112 is coupled to the pivotal arm 114 in a manner which allows the location of the book rest 112 along the length of the pivotal arm 114 to be adjusted and also allows the angle of the top surface of the book rest relative to a horizontal plane to be adjusted, as discussed above with respect to the coupling of book rest 22 to pivotal arm 14.

One end 120 of the pivotal arm 114 is pivotally coupled to the top surface of the accessory tray 116 by a suitable pivotal coupling structure 122, such as a rotating axle structure, fixed axle and rotor structure, ball bearing structure or the like. The clamp 118 is coupled to the bottom surface of the accessory tray 116 and extends downward, such that the tray 116 may be placed on the upper ledge of the tub side wall 101 with the clamp 118 extending downward, adjacent the side wall 101, directly below the tray 116.

Figure 9:
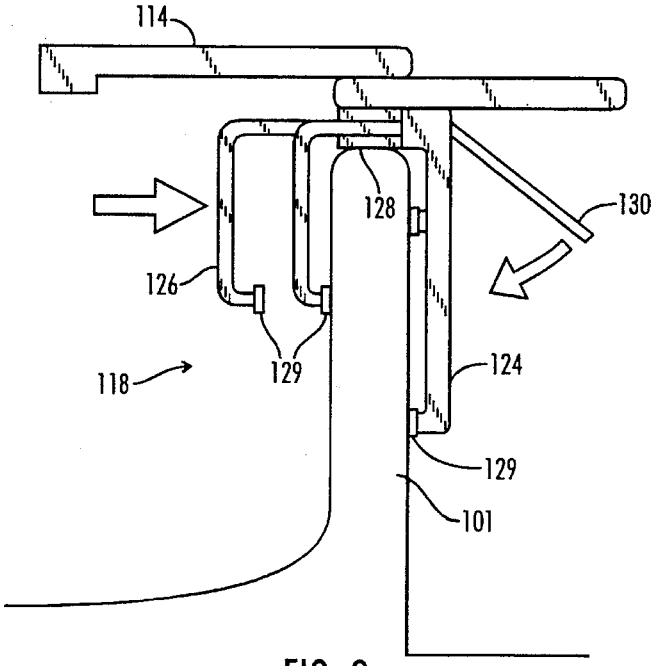
FIG. 9 is a side view of the bathtub tray in FIG. 7.

As shown in FIG. 9, the clamp 118 comprises an outer bearing member 124 and an inner bearing member 126 adapted to abut the outer surface of tub side wall 101 and the inner surface of tub side wall 101, respectively. The clamp 118 also includes a base portion 128 which abuts the upper surface of tub side wall 101. Friction pads 129 are provided on the side wall abutting surfaces of the bearing members 124 and 126 to minimize slipping or damage to the bathtub surfaces. A similar friction pad may be provided on the tub side wall abutting surface of the clamp base 128.

Preferably, the width of the clamp (spacing between bearing members 124 and 126 when in the closed or clamping state) is adjustable to accommodate various bathtub sidewall 101 widths. The clamp is opened or closed (set in the unclamped state or clamped state) by a clamp handle 130.

Figure 10:
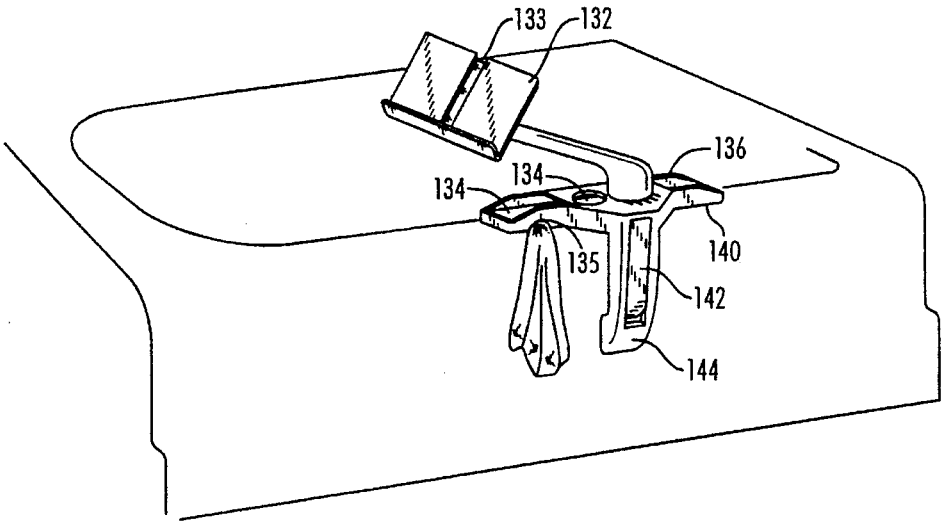
FIG. 10 is perspective view of a bathtub tray according to another preferred embodiment of the present invention.

FIG. 10 shows another bathtub caddie embodiment, similar to the embodiment shown in FIG. 7, however, without the accessory table 116 and with certain other modifications. For example, in the FIG. 10 embodiment, a book rest 132 has a spine recess 133. The spine recess tends to keep the book centered on the book back support of the book rest. The FIG. 10 embodiment also includes a recess 134 and an articles holding pin 135. (It will be understood that the spine recess 133, the article recess 134 or the holding pin 135 features may be incorporated in any of the utility tray and caddie embodiments described herein.)

The FIG. 10 embodiment also includes a pair of stabilizer arms 136 and 138 located on either side of the clamp base. Each stabilizer arm has a stabilizer bearing surface 140, which makes contact with the top of the bathtub sidewall 101. The stabilizing arms 136 and 138 restrain the clamp from rotating when the pivotal arm supports a heavy load. In this embodiment, a clamp handle 142 for opening and closing the clamp is recessed in an outer clamp bearing member 144. With the handle 142 recessed in this manner, the handle is less likely to catch on objects or be accidentally released.

Figure 11:
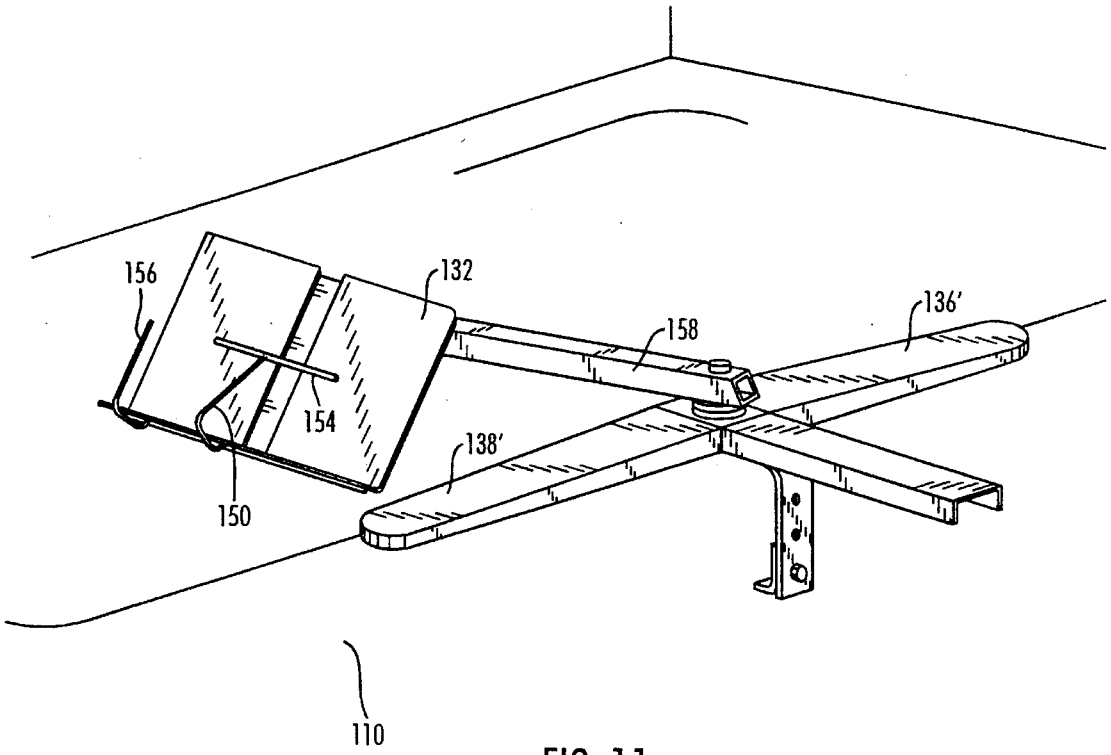
FIG. 11 is perspective view of a bathtub tray according to another preferred embodiment of the present invention.
Figure 12:
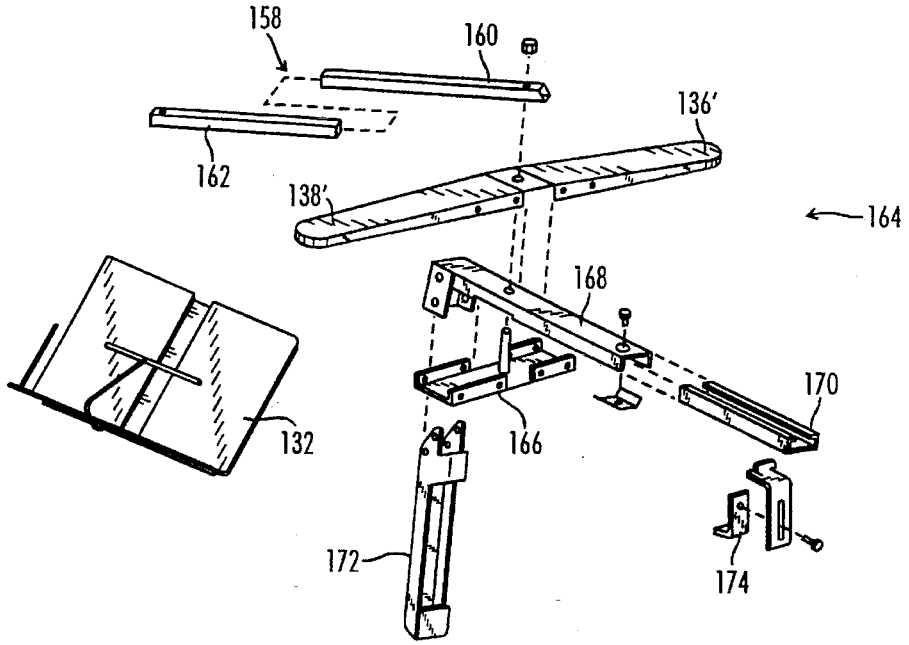
FIG. 12 is an exploded view of the bathtub tray in FIG. 11.
Figure 13:
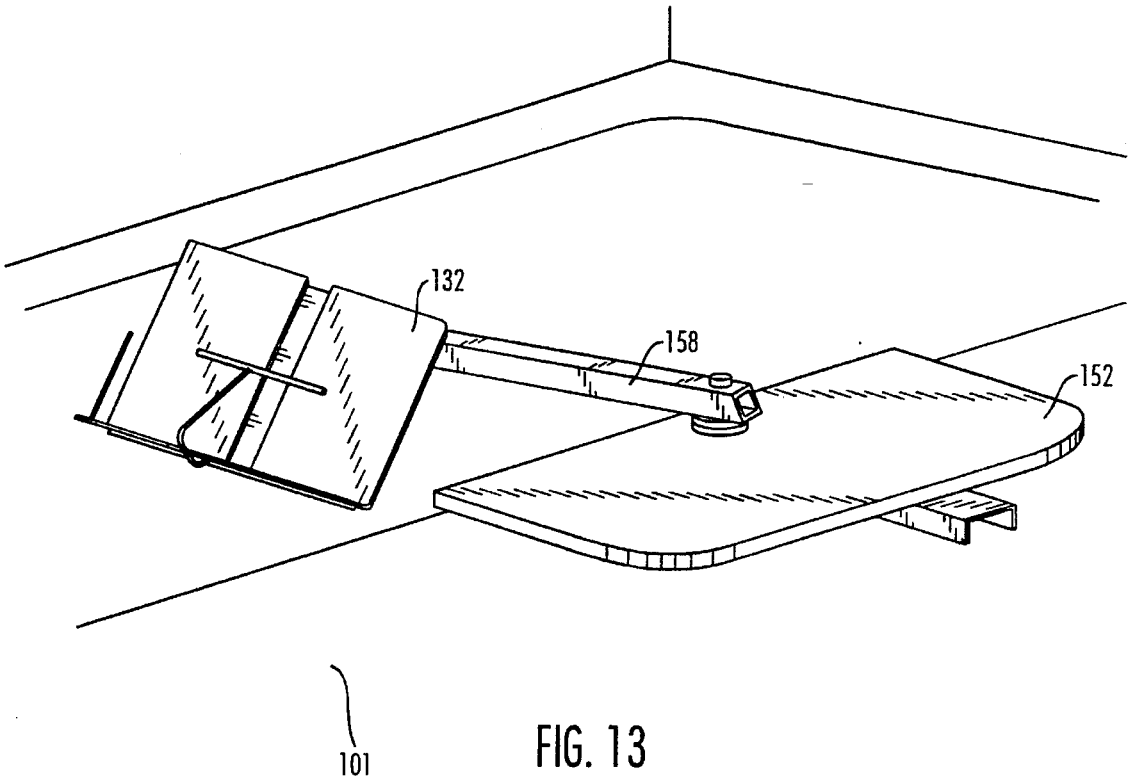
FIG. 13 is perspective view of a bathtub tray in FIG. 11, but with a removable tray.

FIGS. 11–13 show yet another embodiment of a bathtub caddie. The FIG. 11–13 embodiment includes features similar to those described herein with respect to the above discussed embodiments, but further includes a page restrainer 150 and a removable tray 152. The page restrainer has a center guide 154 to abut the center portion of an opened book. A book end holder 156 is arranged near one side edge of the book rest 132 to abut one side of an opened book. The FIG. 11–13 embodiment includes a variation of the clamp stabilizing arms 136' and 138'.

FIG. 12 is an exploded view of the embodiment shown in FIG. 11. As illustrated in FIG. 12, the pivotal arm 158 may be formed of two shafts 160 and 162 arranged in a telescoping manner to provide an arm length adjustment feature, for example, by allowing shaft 162 to slide in and out of shaft 160 to provide a range of arm 158 lengths. It will be understood that the adjustable length pivotal arm feature may be incorporated in other embodiments discussed herein.

The clamp 164 has a clamp base composed of a top surface abutting member 166 for abutting the top surface of a tub side wall 101. An adjustment track 168 is coupled to the arms 136' and 138' and provides a guide in which rail 170 is slidable to adjust the width of the clamp. Bathtub side wall abutting member 172 is coupled to one end of the track 168 and bathtub side wall abutting member 174 is coupled to the slidable rail 170. In this embodiment, the clamp handle is formed integral with the wall abutting member 172. As shown in FIG. 13, the removable tray 152 may be placed on and supported by the arms 136' and 138' and track 168. It will be understood that features of clamp 164 or removable tray 152 may be incorporated in other embodiments discussed herein.

The above embodiments show an invention that allows easy installation, adjustment and removal. It also provides flexibility and security for articles that it supports. The invention is capable of working on other fixture besides bathtubs, such as furniture and the like.

While several particular forms of the invention have been illustrated and described, it will also be apparent that various modifications can be made without departing from the spirit and scope of the invention. For example, while embodiments of the invention may be particularly suitable for mounting to or in the vicinity of a bathtub, further embodiments may be adapted for use with other fixtures, such as furniture, vehicles interiors, laboratory fixtures, workshop fixtures or the like.

What is claimed is:

1. A utility tray apparatus to be secured to a fixture, the utility tray comprising:

a support member having a length dimension;

means for securing the support member to the fixture with the length dimension of the support member being arranged substantially vertically;

a pivotal arm pivotally coupled to the support member for pivotal motion relative to the support member, the pivotal arm having a length dimension, the pivotal arm being movable along at least a portion of the length of the support member;

a first coupler for securing the pivotal arm to the support member at a selectable location along the length dimension of the support member;

a tray supported by the pivotal arm and movable along the length dimension of the pivotal arm; and a second coupler for securing the tray to the pivotal arm at a selectable location along the length dimension of the pivotal arm.

2. A utility tray as recited in claim 1, wherein the support member is elongated and wherein the means for securing comprises at least one suction cup fixed to the support member along the length of the support member.

3. A utility tray as recited in claim 1, wherein:

the pivotal arm has a circular aperture;

the support member is elongated and has a cylindrical portion along at least a portion of the length of the support member; and the cylindrical portion of the support member extends through the circular aperture in the pivotal arm such that the pivotal arm is pivotal about the axis of the cylindrical portion of the support member.

4. A utility tray as recited in claim 3, wherein:

the first coupler comprises a ring coupled to the cylindrical portion of the support member adjacent the pivotal arm.

5. A utility tray apparatus as recited in claim 1 wherein the tray defines a top surface, the apparatus further comprising adjustment means for adjusting the angle of the top surface of the tray relative to a horizontal plane along the axis of the pivotal arm.

6. A utility tray apparatus to be secured to a fixture, the utility tray comprising:

a support member;

means for securing the support member to the fixture;

a pivotal arm pivotally coupled to the support member for pivotal motion relative to the support member; and a tray supported by the pivotal arm;

wherein the pivotal arm has a polygonal cross-section along at least a portion of the length of the pivotal arm;

wherein the tray defines a top surface and a bottom surface and has a bracket mating member on the bottom surface;

wherein the bracket mating member has a first plurality of surface areas defining a first portion of the boundary of a polygonal shaped passage;

wherein the utility tray apparatus further comprises a coupling bracket having a second plurality of surface areas defining a second portion of the boundary of the polygonal shaped passage:

wherein the first plurality of surface areas and the second plurality of surface areas cooperate to define a polygonal shaped passage through which the polygonal cross-section portion of the pivotal arm extends.

7. A utility tray as recited in claim 6, wherein the polygonal shaped passage provided by the first and second pluralities of surface areas is adapted to receive the polygonal cross-section portion of the pivotal arm with the polygonal shaped passage directed at any one of a plurality of selectable angular orientations relative to a horizontal plane along the axis of the pivotal arm.

8. A utility tray as recited in claim 6, wherein a portion of the length of the pivotal arm has a circular cross section shape which allows the book rest to rotate about the axis of the circular cross section portion of the pivotal arm upon the circular cross section portion being located within the polygonal passage defined by the first and second pluralities of surface areas.

9. A bathtub caddie to be secured to a wall adjacent a bathtub, the caddie comprising:

a support member having a length dimension;

at least one suction cup coupled to the support member for securing the support member to the wall with the length dimension of the support member being arranged substantially vertical;

a pivotal arm pivotally coupled to the support member for pivotal motion relative to the support member, the pivotal arm having a length dimension, the pivotal arm being movable along at least a portion of the length of the support member;

a first coupler for securing the pivotal arm to the support member at a selectable location along the length dimension of the support member;

a tray supported by the pivotal arm and movable along the length dimension of the pivotal arm; and a second coupler for securing the tray to the pivotal arm at a selectable location along the length dimension of the pivotal arm.

10. A bathtub caddie as recited in claim 9, wherein the support member is elongated.

11. A bathtub caddie as recited in claim 9, wherein:

the pivotal arm has a circular aperture;

the support member is elongated and has a cylindrical portion along at least a portion of the length of the support member; and the cylindrical portion of the support member extends through the circular aperture in the pivotal arm such that the pivotal arm is pivotal about the axis of the cylindrical portion of the support member.

12. A bathtub caddie as recited in claim 9, wherein the tray defines a top surface and the caddie further comprises adjustment means for adjusting the angle of the top surface of the tray relative to a horizontal plane along the axis of the pivotal arm.

13. A utility tray apparatus to be secured to a fixture, the utility tray comprising:

a support member having a length dimension;

means for securing the support member to the fixture with the length dimension of the support member being arranged substantially vertical;

a pivotal arm pivotally coupled to the support member for pivotal motion relative to the support member, the pivotal arm being movable along at least a portion of the length of the support member;

a first coupler for securing the pivotal arm to the support member at a selectable location along the length dimension of the support member;

a tray supported by the pivotal arm;

wherein the means for securing comprises at least one suction cup having a shaft extending therefrom;

wherein the support member is elongated and has a plurality of apertures provided along the length of the support arm, said plurality of apertures comprising at least one more aperture than suction cups; and wherein the shaft extending from each suction cup is dimensioned to fit within any one of the plurality of apertures along the length of the support arm to secure the suction cup to the support member at any one of plural positions along the length of the support arm such that the position of each suction cup along the length of the support arm is selectable.

14. A bathtub caddie to be secured to a wall adjacent a bathtub, the caddie comprising:

a support member having a length dimension;

at least one suction cup coupled to the support member for securing the support member to the wall with the length dimension of the support member being arranged substantially vertical;

a pivotal arm pivotally coupled to the support member for pivotal motion relative to the support member, the pivotal arm having a length dimension, the pivotal arm being movable along at least a portion of the length of the support member;

a first coupler for securing the pivotal arm to the support member at a selectable location along the length dimension of the support member;

a tray supported by the pivotal arm and movable along the length dimension of the pivotal arm;

a second coupler for securing the tray to the pivotal arm at a selectable location along the length dimension of the pivotal arm; and wherein the support member is elongated and has a plurality of apertures provided along the length of the support member, said plurality of apertures comprising at least one more aperture than suction cups; and wherein the shaft extending from each suction cup is dimensioned to fit within any one of the plurality of apertures along the length of the support member to secure the suction cup to the support member at any one of plural positions along the length of the support member such that the position of each suction cup along the length of the support member is selectable.

* * * * *